US007611029B2

(12) United States Patent
Wong

(10) Patent No.: US 7,611,029 B2
(45) Date of Patent: Nov. 3, 2009

(54) DRINKING CUP LID WITH A RECLOSABLE DRINK OPENING USING A SLIDING MEMBER

(75) Inventor: Joseph Cheuk Mau Wong, Daly City, CA (US)

(73) Assignee: Double Team Inc., Daly, CA (US)

( * ) Notice: Subject to any disclaimer, the term of this patent is extended or adjusted under 35 U.S.C. 154(b) by 617 days.

(21) Appl. No.: 11/419,163

(22) Filed: May 18, 2006

(65) Prior Publication Data

US 2007/0278228 A1 Dec. 6, 2007

(51) Int. Cl.
*B65D 51/18* (2006.01)
*A47G 19/22* (2006.01)
*B65D 41/18* (2006.01)

(52) U.S. Cl. ..... 220/254.9; 220/714; 220/715; 220/713; 220/780

(58) Field of Classification Search ..... 220/254.1, 220/254.9, 345.1–345.4, 711, 713–715, 780; 222/559, 561; 229/404
See application file for complete search history.

(56) References Cited

U.S. PATENT DOCUMENTS

| | | | | |
|---|---|---|---|---|
| 2,071,960 | A * | 2/1937 | Wilson | 222/542 |
| 2,475,896 | A | 7/1949 | Husted | |
| 2,480,733 | A | 8/1949 | Hermani | |
| 3,174,661 | A | 3/1965 | Speicher | |
| 3,938,690 | A | 2/1976 | Butler | |
| 4,057,167 | A | 11/1977 | Lee | |
| 4,127,212 | A | 11/1978 | Waterbury | |
| 4,170,724 | A | 10/1979 | Waterbury | |
| 4,441,624 | A | 4/1984 | Sokolowski | |
| 4,819,829 | A * | 4/1989 | Rosten et al. | 220/345.3 |
| 5,086,941 | A * | 2/1992 | English et al. | 220/345.2 |
| 5,090,584 | A | 2/1992 | Roberts et al. | |
| 5,197,624 | A | 3/1993 | Dodaro | |
| 5,490,609 | A | 2/1996 | Lane et al. | |
| 5,613,619 | A | 3/1997 | Van Melle | |
| 5,699,927 | A | 12/1997 | Lane et al. | |
| 5,947,323 | A | 9/1999 | Freek et al. | |
| D417,845 | S | 12/1999 | Sadlier et al. | |
| D418,363 | S | 1/2000 | Barnes et al. | |
| 6,089,397 | A | 7/2000 | Van Melle | |

(Continued)

FOREIGN PATENT DOCUMENTS

| | | |
|---|---|---|
| FR | 2295889 | 7/1976 |

(Continued)

*Primary Examiner*—Robin A. Hylton
(74) *Attorney, Agent, or Firm*—Pinnacle Patent Law Group

(57) ABSTRACT

A disposable lid for a drinking cup includes a cover portion having a generally circular periphery and a sliding member that is configured to slidably fit into a trench in the cover portion. The trench extends downwardly from and longitudinally along a top surface of the cover portion, and has an open end at the periphery of the cover portion. The cover portion includes a drink opening on a bottom surface of the trench and adjacent to the periphery and a guide slot on the bottom surface of the trench. The sliding member includes a guide extending downwardly from a bottom surface of the sliding member so that the guide slidably fits into the guide slot on the bottom surface of the trench. The guide slot allows the sliding member to move between a first closed position and a second open position via the guide.

15 Claims, 5 Drawing Sheets

U.S. PATENT DOCUMENTS

| | | | | |
|---|---|---|---|---|
| 6,260,727 | B1 | 7/2001 | Durdon | |
| D447,412 | S | 9/2001 | Durdon | |
| 6,354,454 | B1 | 3/2002 | Wong | |
| 6,505,753 | B1 | 1/2003 | Freek et al. | |
| D476,566 | S | 7/2003 | Smith et al. | |
| D477,223 | S | 7/2003 | Smith et al. | |
| D478,006 | S | 8/2003 | Smith et al. | |
| 6,612,456 | B1 | 9/2003 | Hundley et al. | |
| D489,260 | S | 5/2004 | Smith et al. | |
| D493,718 | S | 8/2004 | Durdon | |
| 6,824,003 | B1 * | 11/2004 | Wong | 220/254.9 |
| 6,889,860 | B2 | 5/2005 | Mazzarolo | |
| 6,929,143 | B2 | 8/2005 | Mazzarolo | |
| 6,948,633 | B2 | 9/2005 | Freek et al. | |
| D514,444 | S | 2/2006 | Smith et al. | |
| D514,445 | S | 2/2006 | Smith et al. | |
| 7,246,715 | B2 | 7/2007 | Smith | |
| 7,275,653 | B2 | 10/2007 | Tedford, Jr. | |
| 2005/0092749 | A1 | 5/2005 | Durdon | |
| 2006/0081633 | A1 | 4/2006 | Schmidtner et al. | |

FOREIGN PATENT DOCUMENTS

| | | |
|---|---|---|
| GB | 239036 | 9/1925 |
| GB | 497184 | 4/1934 |

* cited by examiner

DRINKING CUP LID WITH A RECLOSABLE DRINK OPENING USING A SLIDING MEMBER

FIELD OF THE INVENTION

The present invention relates to a disposable lid for a drinking cup and more particularly to a disposable lid having a slidable drink opening cover.

BACKGROUND OF THE INVENTION

A disposable lid is typically secured over a disposable beverage cup to prevent a beverage from spilling out of the cup. The lid typically has a preformed opening that allows a user to drink the beverage without removing the lid from the cup. Nevertheless, these lids can be problematic because the beverage can spill out of the opening if the user is bumped or if the cup is overturned.

To address this problem, many lids provide a covering member to cover the drink opening when the user is not drinking the beverage. One type of lids includes a resealable drinking flap that may be either pushed into the lid or pulled away from the lid to form the opening. One disadvantage of this type of lid, however, is that it is difficult to manipulate the flap with one hand while holding the cup with the same hand.

Other types of lids have a slidable member that can slide over the drink opening. These lids typically include a lip protruding up from the top surface of the lid and around the circumference of the lid, and the drink opening is typically positioned on the top surface of the lid. Thus, the lip forms a wall around the opening. One disadvantage of this type of lid, however, is that the lip makes it difficult for the user to place his or her mouth directly against the opening. So during drinking, the beverage can leak out of the opening and drip onto the user.

A lid for a nondisposable commuter mug utilizes an H-shaped flap that slides over a preformed opening, which alleviates spillage. Nevertheless, such a lid for a commuter mug is not disposable, is bulky and is relatively expensive to manufacture. Moreover, the H-shaped flap design is not feasible for a disposable lid because the disposable lid is typically manufactured from a thin plastic material that does not exhibit the rigidity required to produce an effective H-shaped flap.

Accordingly, a need exists for a disposable lid for a cup that has an opening through which a user can easily drink a beverage without removing the lid. The lid should prevent the beverage from spilling out of the cup when the user is not drinking from the cup and when the user is drinking. The user should be able to manipulate the lid with one hand. In addition, the lid should be relatively inexpensive to manufacture, and easy to assemble and store. The present invention addresses such needs.

SUMMARY OF THE INVENTION

In one embodiment, a disposable lid for a drinking cup includes a cover portion having a generally circular periphery and a sliding member that is configured to slidably fit into a trench in the cover portion. The trench extends longitudinally along a top surface of the cover portion from approximately a center of the cover portion to the periphery, and has an open end at the periphery of the cover portion. The trench comprises longitudinal side walls that extend downwardly and outwardly from the top surface of the cover portion such that a width of the bottom surface is wider than a width of an opening of the trench. The cover portion includes a drink opening on a bottom surface of the trench adjacent to the periphery and a guide slot on the bottom surface of the trench, into which the sliding member is configured to slidably fit. The width of the sliding member is greater than the width of the opening of the trench and less than or equal to the width of the bottom surface of the trench such that the sliding member is securely attached to the cover portion when the sliding member is in the trench. The sliding member includes a handle extending upward from a top surface of the sliding member and a guide extending downwardly from a bottom surface of the sliding member so that the guide slidably fits into the guide slot on the bottom face of the trench. The guide slot allows the sliding member to move between a first position and a second position via the guide, such that when the sliding member is in the first position, the sliding member covers the drink opening and when the sliding member is in the second position, the sliding member uncovers the drink opening.

In another embodiment, the guide comprises longitudinal side walls that extend downwardly and outwardly from a bottom surface of the sliding member such that a width of a bottom surface of the guide is wider than a width at a top of the guide and a width of an opening formed by the guide slot is greater than or equal to the width at the top of the guide and less than the width of the bottom surface of the guide.

In another embodiment, the cover portion includes a depression in the trench, and the sliding member includes a nub that protrudes downwardly from the bottom surface of the sliding member. In this embodiment, the nub plugs the drink opening when the sliding member is in the first position, and the depression in the trench receives the nub when the sliding member is in the second position.

DESCRIPTION OF THE INVENTION

The present invention relates to a disposable lid for a drinking cup and more particularly to a disposable lid having a slidable drink opening cover. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

According to one embodiment, the disposable lid includes a cover portion that has a trench on the top surface. The trench runs from approximately the center of the cover portion to a periphery, where the trench is open ended. A drink opening is provided in the trench near the open end of the trench and the periphery. A sliding member is configured to slide within the trench between a first position and a second position. In the first position, the sliding member covers the drink opening, while in the second position, the sliding member uncovers the drink opening. The trench includes a guide slot on a bottom surface of the trench that is configured to receive a guide on the sliding member. The guide slot prevents the sliding member from moving beyond the periphery and in one embodiment, securely attaches the sliding member to the cover portion.

Through the aspects of the present invention, the user can hold the cup with one hand and, with the same hand, easily cover and uncover the drink opening. Thus, when the user is not drinking, the user can cover the opening and prevent the beverage from spilling out of the cup. In addition, because the trench is open ended, the user can place his or her mouth directly on the drink opening thereby reducing the risk of spilling the beverage during drinking.

Figure 1A:
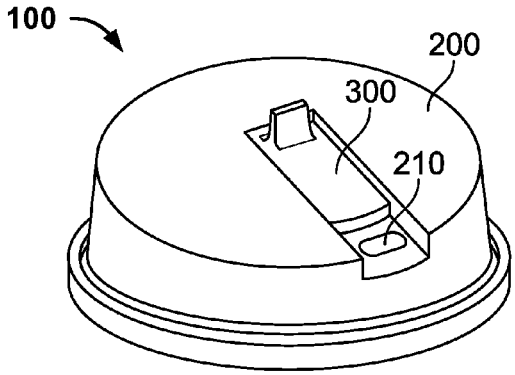
FIGS. 1A and 1B are perspective views of an exemplary lid in a drinking and non-drinking configuration, respectively, according to one embodiment.
Figure 1B:
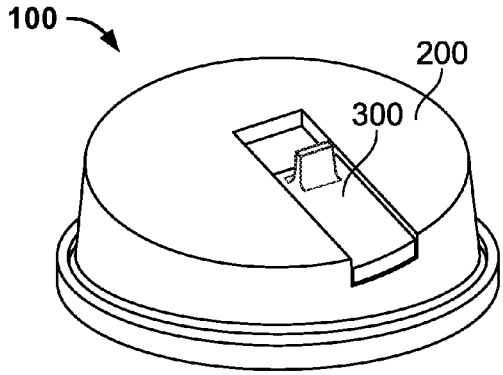

FIGS. 1A and 1B are perspective views of a disposable lid in a drinking and a non-drinking position, respectively, according to one embodiment of the present invention. The disposable lid 100 comprises a cover portion 200 and a sliding member 300 that uncovers a drink opening 210 when a user is drinking, as shown in FIG. 1A, and covers the drink opening 210 when the user is not drinking, as shown in FIG. 1B.

Figure 2A:
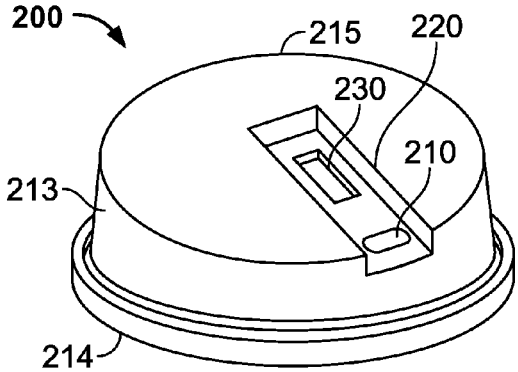
FIG. 2A and FIG. 2B are perspective and top views, respectively, of a cover portion of the lid in accordance with one embodiment.
Figure 2B:
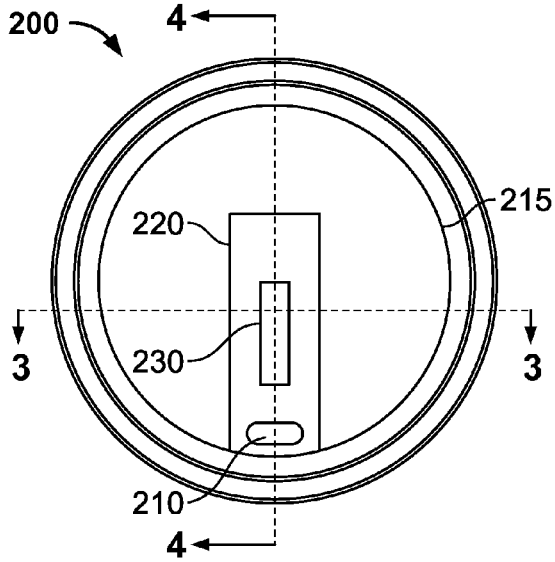

FIG. 2A and FIG. 2B are perspective and top views, respectively, of the cover portion 200 of the lid according to one embodiment of the present invention. Referring to FIG. 2A and FIG. 2B, the cover portion 200 has a generally circular periphery 215, and includes a drink opening 210 adjacent to the periphery 215 that allows the user to drink from the cup without removing the lid 100. The cover portion 200 includes an annular side wall 213 that extends downward from the periphery 215 to an annular mounting portion 214, which secures the cover portion 200 on the cup (not shown).

According to one embodiment, the cover portion 200 includes a trench 220 that runs approximately from the center of the cover portion to the periphery 215. The trench 220 is configured to house the sliding member 300. The drink opening 210 is located on a bottom surface of the trench. In addition, a guide slot 230 is also located on the bottom surface of the trench. The guide slot 230 is configured to limit the movement of the sliding member 300 between the first and second positions. More details relating to the interaction between the sliding member 300 and the cover portion 200 will be provided below.

Figure 3A:
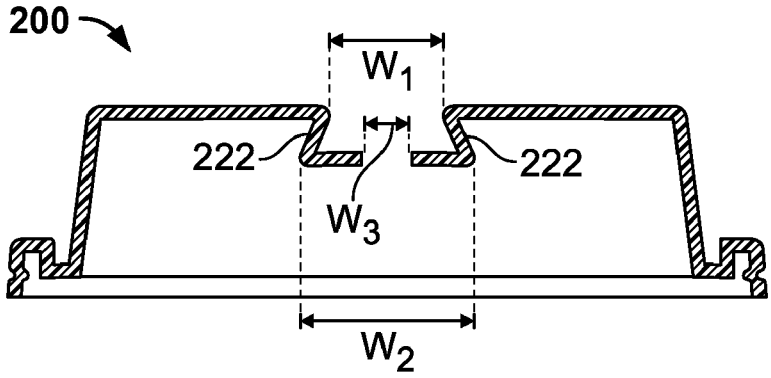
FIGS. 3A and 3B are across-sectional side views of the cover portion taken along line 3-3 according to several embodiments.
Figure 4A:
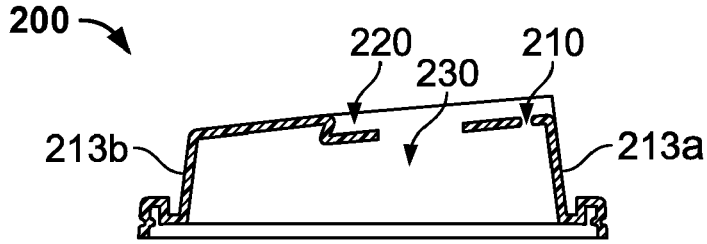
FIGS. 4A and 4B are cross-sectional side views of the cover portion taken along line 4-4 according to several embodiments.

FIG. 3A is a cross-sectional side view of the cover portion 200 along line 3-3 of FIG. 2B and FIG. 4A is a cross-sectional side view of the cover portion 200 along line 4-4 according to one embodiment of the present invention. As is shown, the trench 220 includes longitudinal sidewalls 222 that extend out to the periphery 215. In one embodiment, the sidewalls 222 extend downward from the cover portion 200 and flare outward, i.e., away from one another, such that a width of the trench opening, W1, is less than a width of the bottom surface of the trench, W2. By flaring the sidewalls 222 to widen the width of the trench 220, the sliding member 300 can be secured to the cover portion 200 when the width of the sliding member 300 is greater than the width of the trench's opening, W1, and less than or equal to the width of the bottom surface of the trench 220, W2.

In the embodiment illustrated in FIG. 3A and FIG. 4A, the guide slot 230 forms an opening through the cover portion 200. In another embodiment, shown in FIGS. 3B and 4B, the guide slot forms a second trench 230*a* in the bottom surface of the trench 220. In this embodiment, the second trench 230*a* is more resilient and less resistant to tearing because it is one continuous piece. Accordingly, the structural integrity of the cover portion 200 can be improved.

Figure 4B:
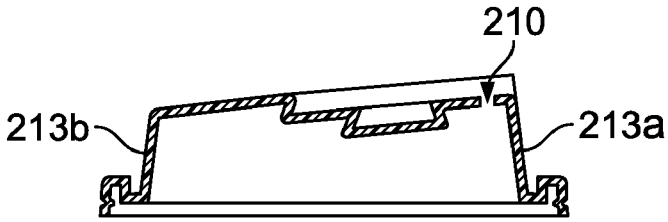

Referring to FIG. 4A and FIG. 4B, the annular side wall 213 can be of varying height. In particular, it can be higher at a point 213*a* adjacent to the drinking opening 210 and lower at a point 213*b* directly opposite to the drinking opening 210. This variation in height makes it easier for the user to place his or her mouth over the drink opening 210 to the drink without spillage.

As stated above, the sliding member 300 sits in the trench 220 and slides longitudinally within the trench 220 between first and second positions. In the first position, shown in FIG. 1B, the drink opening 210 is covered by the sliding member 300, while in the second position, shown in FIG. 1A, the drink opening 210 is covered.

Figure 5A:
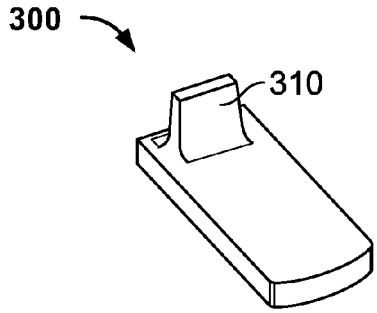
FIGS. 5A-5D are perspective top, perspective bottom, side and front views, respectively, of a sliding member according to one embodiment.
Figure 5B:
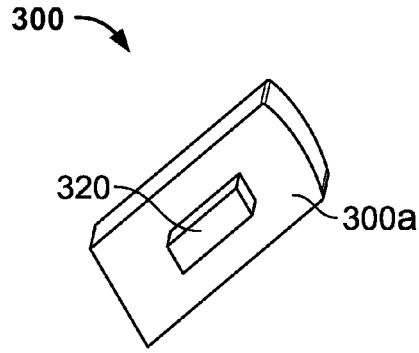
Figure 5C:
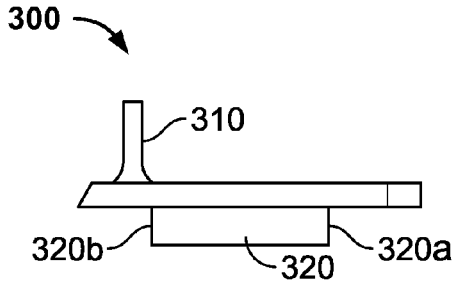
Figure 5D:
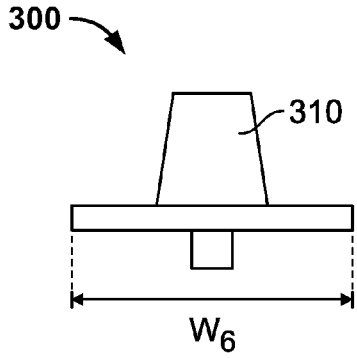

FIGS. 5A-5E are top and bottom perspective, side and front views, respectively, of the sliding member 300 according to one embodiment. As is shown in FIG. 5A, the sliding member 300 includes a handle 310 that extends substantially perpendicularly from one end of a top surface of the sliding member 300 and that allows the user to move the sliding member 300 within the trench 220. According to one embodiment, the sliding member 300 includes a guide 320 that extends downward from a bottom surface 300*a* of the sliding member 300 and in one embodiment can extend longitudinally along the bottom surface of the sliding member 300*a*, as shown in FIG. 5B and FIG. 5C.

When the sliding member 300 is sitting in the trench 220, the guide 320 is configured to fit into the guide slot 230, 230*a*. In one embodiment, a length of the guide 320 is correlated to a length of the guide slot 230, 230*a* such that when a front end of the guide 320*a* abuts a front end of the guide slot 230, the sliding member 300 is in the first position and covers the drink opening 210 (as shown in FIG. 1B), and when a back end of the guide 320*b* abuts a back end of the guide slot 230, the sliding member 300 is in the second position (as shown in FIG. 1A). Accordingly, the interaction between the guide 320 and the guide slot 230 prevents the sliding member 300 from extending beyond the periphery 215 of the cover portion 200.

As stated above, the sliding member 300 can be securely attached to the cover portion 200 by flaring the sidewalls 222 of the trench 220 so that the width of the opening of the trench 220, W1, is less than a width of the sliding member 300, W6, which is less than or equal to the width of the bottom surface of the trench 220, W2. FIG. 3C is a cross-sectional side view of the lid 100 along line 3-3, and shows this configuration.

Figure 5E:
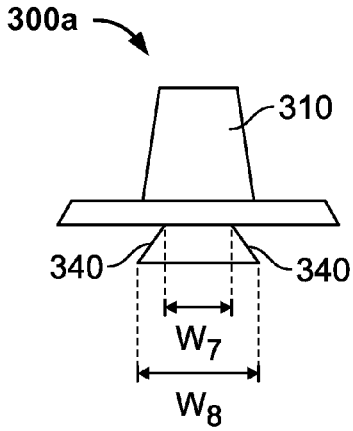
FIG. 5E is a front view of the sliding member according to another embodiment.

In another embodiment, the sliding member 300 can be securely attached to the cover portion 200 through the guide 320 and the guide slot 230. In this embodiment, the guide 320 has flared longitudinal sidewalls 340, that extend down from the sliding member 300 such that a width, W7, at a top of the guide 320, is less than a width, W8, at a bottom of the guide 320, as shown in FIG. 5E. The guide slot 230 forms an opening having a width, W3, as shown in FIG. 3A. The sliding member 300 can be securely attached to the cover portion 200 when the width, W7, at a top of the guide 320 is less than the width, W3, of the opening of the guide slot 230, which is less than the width, W8, at a bottom of the guide 320, as shown in FIG. 3D.

According to another embodiment, the front end 320*a* of the guide 320 and the back end 320*b* of the guide 320 can flare outward from the bottom surface 300*a* of the sliding member 300 such that a length of the bottom surface of the guide is longer than a length at the top of the guide. By flaring the front and back ends 320*a*, 320*b*, the sliding member 300 can be further secured to the front edge of the guide slot 230 and to the back edge of the guide slot 230 when the sliding member 300 abuts either edge.

Figure 3B:
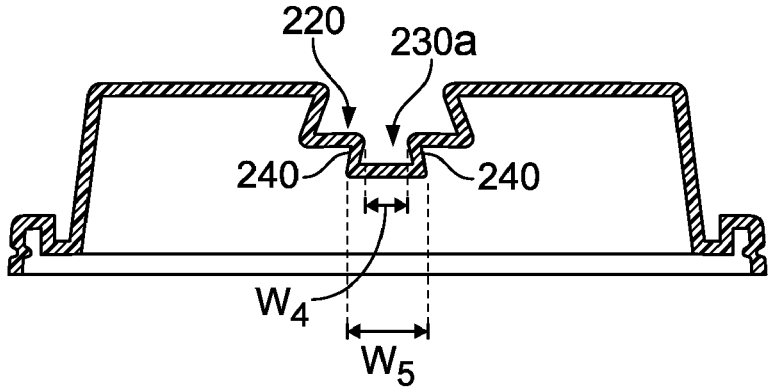
Figure 3C:
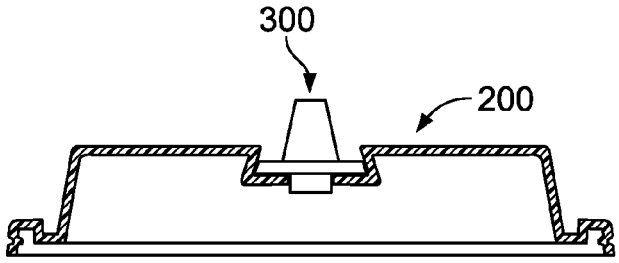
FIGS. 3C, 3D and 3E are cross-sectional side views of the cover portion taken along line 3-3 and the sliding member according to several embodiments.
Figure 3D:
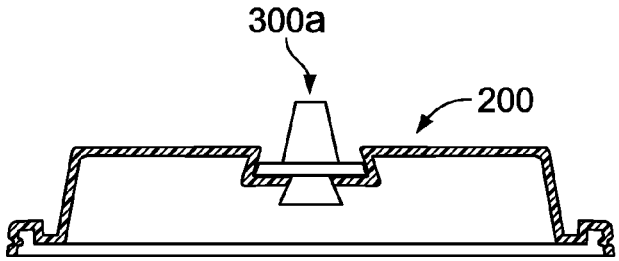
Figure 3E:
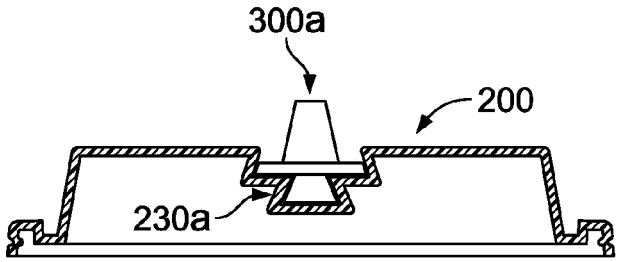

In another embodiment, the second trench 230*a* can include flared longitudinal sidewalls 240 that extend down from the bottom of the trench 220 such that a width, W4, at an opening of the second trench 230*a* is less than a width, W5, at a bottom of the second trench 230*a*, as shown in FIG. 3B. In this embodiment, the sliding member 300*a* shown in FIG. 5E can be securely attached to the cover portion when the width, W4, at an opening of the second trench 230*a* is substantially equal to but greater than the width, W7, at a top of the guide 320, and the width, W5, at a bottom of the second trench 230*a* is substantially equal to but greater than the width, W8, at a bottom of the guide 320, as shown in FIG. 3E.

Figure 6A:
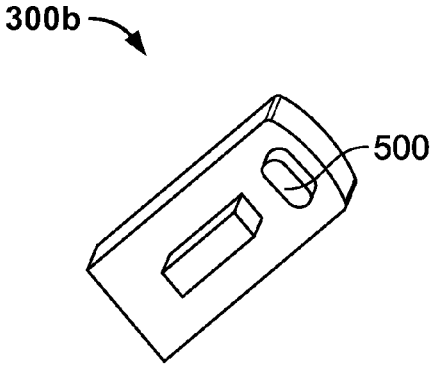
FIGS. 6A-6C are bottom perspective, side and front side views, respectively, of the sliding member according to another embodiment.
Figure 6B:
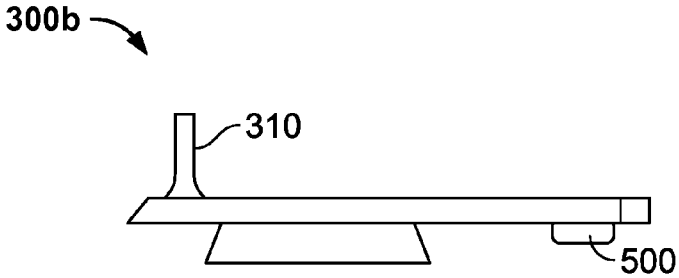
Figure 6C:
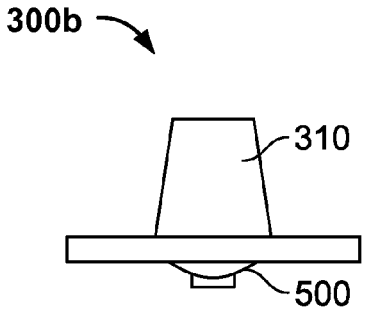

FIG*s*. 6A-6C illustrate bottom perspective, side and front views of the sliding member 300*b* according to another embodiment. As is shown, in this embodiment, the sliding member 300*b* further can include a nub 500 on the bottom surface of the sliding member 300*b* at an opposite end to the end having the handle 310, as shown in FIG. 6B. When the sliding member 300*a* is in the first position, as shown in FIG. 1B, the nub 500 is configured to fit into and plug the drink opening 210 to provide better protection against spillage.

Figure 7A:
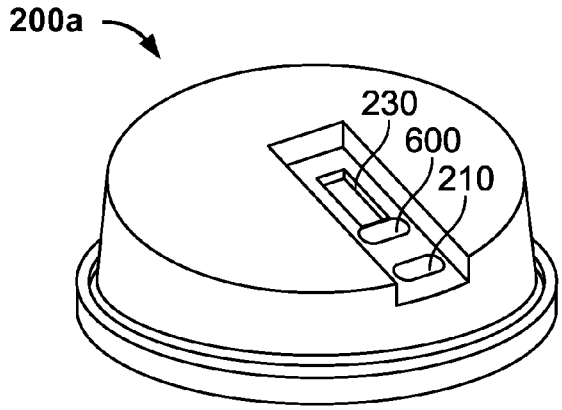
FIGS. 7A and 7B are perspective and top views, respectively, of the cover portion according to another embodiment.
Figure 7B:
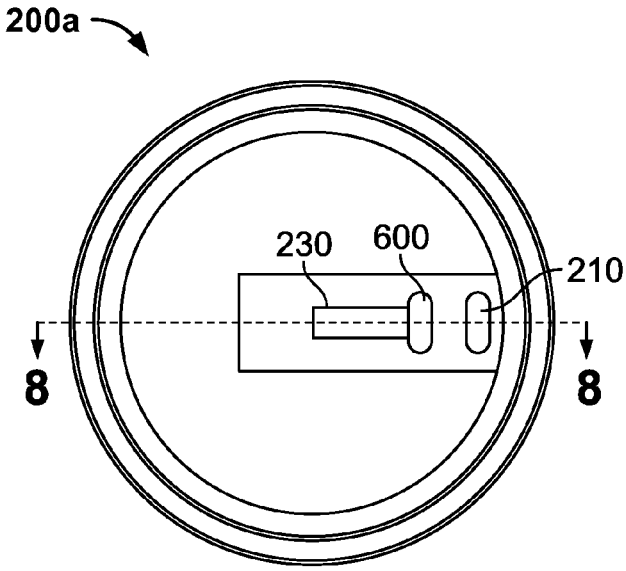
Figure 8:
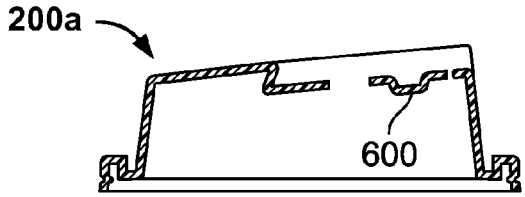
FIG. 8 is a cross-sectional side view of the cover portion of FIG. 7B taken along line 8-8.

In another embodiment, shown in FIGS. 7A, 7B, and 8A, the cover portion 200*a* can include a depression 600 in the trench 220 between the guide slot 230 and the drink opening 210. The depression 600 is configured to receive the nub 500 of the sliding member 300*b* when the sliding member 300*b* is in the second position, i.e., when the drink opening 210 is uncovered. In this manner, the sliding member 300*b* can remain flush with the trench 220 when the sliding member 300*b* is in the second position.

Although the present invention has been described in accordance with the embodiments shown, one of ordinary skill in the art will readily recognize that there could be variations to the embodiments. For example, while the handle 310 has been described and illustrated as being located at an end of the sliding member 300 opposite an end that covers the drink opening 210, one skilled in the art would readily recognize that the handle 310 can be located in the middle of the sliding member 300 or near the end covering the drink opening 210. Those variations would be within the spirit and scope of the present invention. Accordingly, many modifications may be made by one of ordinary skill in the art without departing from the spirit and scope of the appended claims.

What is claimed is:

1. A disposable lid for a drinking cup comprising:

a cover portion having a generally circular periphery, the cover portion comprising:

a trench extending longitudinally from approximately a center of the cover portion to the periphery and along a top surface of the cover portion, the trench having an open end at the periphery of the cover portion, and wherein the trench comprises longitudinal side walls that extend downwardly and outwardly from the top surface of the cover portion such that a width of the bottom surface of the trench is wider than a width of an opening of the trench;

a drink opening on a bottom surface of the trench and adjacent to the periphery; and a guide slot on the bottom surface of the trench; and a sliding member configured to slidably fit into the trench, wherein a width of the sliding member is greater than the width of the opening of the trench and less than or equal to the width of the bottom surface of the trench such that the sliding member is securely attached to the cover portion when the sliding member is in the trench, and wherein the sliding member comprises:

a handle extending upwardly from a top surface of the sliding member; and a guide extending downwardly from a bottom surface of the sliding member, the guide configured to slidably fit into the guide slot on the bottom surface of the trench;

wherein, the guide slot allows the sliding member to move between a first position and a second position via the guide, such that when the sliding member is in the first position, the sliding member covers the drink opening and when the sliding member is in the second position, the sliding member uncovers the drink opening.

2. The lid of claim 1 wherein the guide slot forms an opening at the bottom surface of the trench.

3. The lid of claim 2 wherein the guide comprises longitudinal side walls that extend downwardly and outwardly such that a width of a bottom surface of the guide is wider than a width at a top of the guide.

4. The lid of claim 3 wherein a width of the opening formed by the guide slot is greater than or equal to the width at the top of the guide and less than the width of the bottom surface of the guide such that the sliding member is securely attached to the cover portion via the guide when the sliding member is in the trench.

5. The lid of claim 3 wherein the guide further comprises front and back walls that extend downwardly and outwardly such that a length of the bottom surface of the guide is longer than a length of the top of the guide and the sliding member is securely attached to the cover portion when the sliding member is in either the first or second positions.

6. The lid of claim 1 wherein the guide slot forms an opening through the bottom surface of the trench, wherein the guide in the sliding member extends through the opening when the sliding member is in the trench.

7. The lid of claim 1 wherein the guide slot comprises a second trench extending downwardly from the bottom surface of the trench and extending longitudinally along the bottom surface of the trench, wherein the second trench is configured to receive the guide in the sliding member when the sliding member is in the trench.

8. The lid of claim 7 wherein the second trench comprises longitudinal side walls that extend downwardly and outwardly such that a width of a bottom surface of the second trench is wider than a width at a top of the second trench.

9. The lid of claim 8 wherein the width at the top of the second trench is greater than or equal to a width at a top of the guide and the width of the bottom surface of the second trench is greater than or equal to a width at a bottom surface of the guide.

10. The lid of claim 1 wherein the sliding member further comprises a nub such that when the sliding member is in the first position, the nub plugs the drink opening.

11. The lid of claim 10 wherein the cover portion further includes a depression in the trench that is configured to receive the nub when the sliding member is in the second position.

12. The lid of claim 1 wherein the cover portion further includes an annular side wall depending from the periphery and extending downward to a mounting portion for securing the lid to a cup, the side wall having a first height at a first point adjacent to the drink opening and a second height at a second point directly opposite to the first point, wherein the first height is greater than the second height.

13. A thermoformed plastic disposable lid for a drinking cup comprising:

a cover portion having a generally circular periphery, the cover portion comprising:

a trench extending longitudinally along a top surface of the cover portion, the trench comprising an open end at the periphery of the cover portion and longitudinal side walls that extend downwardly and outwardly from the top surface of the cover portion such that a width of the bottom surface of the trench is wider than a width of an opening of the trench;

a drink opening on a bottom surface of the trench and adjacent to the periphery; and a guide slot on the bottom surface of the trench; and a sliding member configured to slidably fit into the trench, wherein a width of the sliding member is greater than the width of the opening of the trench and less than or equal to the width of the bottom surface of the trench and wherein the sliding member comprises:

a handle extending upward from a top surface of the sliding member; and a guide comprising longitudinal side walls that extend downwardly and outwardly from a bottom surface of the sliding member such that a width of a bottom surface of the guide is wider than a width at a top of the guide, the guide configured to slidably fit into the guide slot on the bottom surface of the trench, wherein a width of an opening formed by the guide slot is greater than or equal to the width at the top of the guide and less than the width of the bottom surface of the guide;

wherein, the guide slot allows the sliding member to move between a first position and a second position via the guide, such that when the sliding member is in the first position, the sliding member covers the drink opening and when the sliding member is in the second position, the sliding member uncovers the drink opening.

14. A thermoformed plastic disposable lid for a drinking cup comprising:

a cover portion having a generally circular periphery, the cover portion comprising:

a trench extending longitudinally along a top surface of the cover portion, the trench having an open end at the periphery of the cover portion;

a drink opening on a bottom surface of the trench and adjacent to the periphery;

a guide slot that forms an opening at the bottom surface of the trench; and a depression in the trench; and a sliding member configured to slidably fit into the trench, wherein the sliding member comprises:

a handle extending upward from a top surface of the sliding member; and a guide extending downwardly from a bottom surface of the sliding member, the guide configured to slidably fit into the guide slot on the bottom surface of the trench, wherein a width of the opening formed by the guide slot is greater than or equal to the width at the top of the guide and less than the width of a bottom surface of the guide; and a nub that protrudes downwardly from the bottom surface of the sliding member;

wherein, the guide slot allows the sliding member to move between a first position and a second position via the guide, such that when the sliding member is in the first position, the sliding member covers the drink opening and when the sliding member is in the second position, the sliding member uncovers the drink opening and wherein the nub plugs the drink opening when the sliding member is in the first position, and the depression in the trench receives the nub when the sliding member is in the second position.

15. The lid of claim 1 wherein the guide comprises longitudinal side walls that extend downwardly from a bottom surface of the sliding member such that a latitudinal cross-section of the guide forms one of a rectangle, a square and a trapezoid.

* * * * *